United States Patent [19]

Siffrin

[11] Patent Number: 4,546,707

[45] Date of Patent: Oct. 15, 1985

[54] RAIL-MOUNTED CONVEYANCE

[75] Inventor: Horst Siffrin, Merchweiler, Fed. Rep. of Germany

[73] Assignee: Walter Becker GmbH, Friedrichsthol, Fed. Rep. of Germany

[21] Appl. No.: 494,184

[22] Filed: May 13, 1983

[30] Foreign Application Priority Data

May 29, 1982 [DE] Fed. Rep. of Germany ..... 3220484

[51] Int. Cl.[4] ..... B61F 5/00; B61D 11/00

[52] U.S. Cl. ..... 105/199 R; 105/157 R; 105/199 A; 105/203

[58] Field of Search ..... 105/199 A, 199 R, 164, 105/200, 203, 157, 275; 414/681; 298/9, 17.7, 17.8; 198/799, 802; 248/181, 182; 104/46

[56] References Cited

U.S. PATENT DOCUMENTS

| | | | |
|---|---|---|---|
| 54,125 | 4/1866 | Dawson | 105/199 R |
| 853,531 | 5/1907 | Brown | 105/200 |
| 1,325,609 | 12/1919 | Bauer | 105/275 |
| 1,770,827 | 7/1930 | Algrain | 105/199 R |
| 3,911,830 | 10/1975 | Adams | 105/157 R |
| 4,085,682 | 4/1978 | Nelson et al. | 105/157 R |

FOREIGN PATENT DOCUMENTS

| | | | |
|---|---|---|---|
| 0069752 | 1/1893 | Fed. Rep. of Germany | 104/46 |
| 0395665 | 7/1933 | United Kingdom | 105/199 R |

*Primary Examiner*—Robert B. Reeves
*Assistant Examiner*—Dennis C. Rodgers
*Attorney, Agent, or Firm*—Peter K. Kontler

[57] ABSTRACT

A rail-mounted conveyance wherein two undercarriages support a superstructure. One of the undercarriages is movable with reference to the superstructure about three axes including a substantially horizontal X-axis extending in the direction of travel of the conveyance, a substantially horizontal Y-axis which extends transversely of the direction of travel of the conveyance, and a substantially vertical Z-axis which is normal to the other two axes. Movements about the X-axis are made possible by providing the one undercarriage with a transverse axle which defines the Y-axis and carries a block having a convex top surface sloping from the center toward both sides of the one undercarriage, and by providing the superstructure with a platform having a flat underside which abuts against and can roll along the convex surface. The line of contact between the block and the platform defines the first axis. The platform has two downwardly extending pyramidal projections which are partially or fully received in complementary sockets provided in the convex surface of the block at the opposite sides of the center of the one undercarriage, as considered in the direction of the Y-axis. These projections prevent other but rolling movements of the underside of the platform with reference to the convex surface and/or vice versa.

20 Claims, 4 Drawing Figures

PRIOR ART

RAIL-MOUNTED CONVEYANCE

BACKGROUND OF THE INVENTION

The present invention relates to vehicles in general, and more particularly to improvements in rail-mounted conveyances, especially to improvements in conveyances which can be used in mines and other types of underground excavations to transport ore from and/or to transport workers and/or material into the excavation. Still more particularly, the invention relates to improvements in rail-mounted conveyances of the type wherein the superstructure (e.g., a receptacle for deposition of ore therein or thereon) is mounted on several undercarriages one of which permits the superstructure to move about three mutually inclined axes with respect to the one undercarriage and/or vice versa.

Three-dimensional articulation of the superstructure with reference to one of the undercarriages is necessary when the conveyance travels along an arcuate path which slopes upwardly or downwardly. If the conveyance is to take a curve which is disposed in a horizontal plane, each undercarriage should be free to turn with reference to the superstructure about a vertical axis, i.e., about an axis which is normal to the plane of the curve. If a straight path slopes upwardly or downwardly, the undercarriages should be free to turn with reference to the superstructure and/or vice versa about horizontal axes which extend transversely of the direction of travel of the conveyance. Finally, and as mentioned above, if the rail or rails slope upwardly in a curve, one of the undercarriages must be free to pivot about a third axis, namely, about an axis which extends substantially in the direction of travel of the conveyance and is normal to the other two axes. This is due to the fact that mere movability of the two carriages about a vertical and about a transverse horizontal axis would not enable one of the undercarriages to perform with reference to the other undercarriage that movement which is necessary to keep the wheels of both carriages in contact with the rails while the two undercarriages travel along an arcuate path and one of the undercarriages is located at a level above the other undercarriage. The situation is further complicated due to the fact that, in a curve, one of the rails is normally located at a level above the other rail. Absence of exact parallelism of the rails and/or the placing of one of the rails at a level above the other rail is accounted for within an undercarriage in that the wheels at one side of the conveyance are mounted on a first rocker arm, that the wheels of the same undercarriage at the other side of the conveyance are mounted on a second rocker arm, and that the two rocker arms can turn about the horizontal axis which extends transversely of the direction of movement of the conveyance.

The ability of the superstructure in a conventional conveyance to turn about an axis (hereinafter called X-axis) which extends in the direction of travel of the conveyance necessitates the placing of the center of gravity of the load to a higher level because the platform which carries the load must be raised sufficiently to avoid interference with the one or the other rocker arm when the platform is pivoted about the X-axis. This affects the stability of the conveyance and of the load thereon. The just discussed drawback of heretofore known conveyances which employ an undercarriage capable of turning about three axes including the X-axis cannot be overcome by widening the track (i.e., the distance between the two rails). Moreover, a widening of the track is often extremely difficult or plain impossible. This is due to the fact that, if the distance between the rails (and hence the distance between the two rocker arms of the three-dimensionally movable undercarriage) is increased, the distance between the level of the rocker arms and the platform must also be increased if the extent of pivotability of the platform about the X-axis is to remain unchanged.

OBJECTS AND SUMMARY OF THE INVENTION

An object of the invention is to provide a novel and improved conveyance which is constructed in such a way that the center of gravity of the load can be moved to a lower level than in heretofore known conveyances in spite of the fact that one of the undercarriages is free to pivot about three mutually inclined axes.

Another object of the invention is to provide a conveyance which exhibits the above outlined advantage irrespective of the distance between the rails.

A further object of the invention is to provide the conveyance with novel and improved means for articulately connecting an undercarriage to the superstructure for movement about three mutually inclined axes.

An additional object of the invention is to provide a novel and improved undercarriage for use in rail-mounted conveyances.

Still another object of the invention is to provide a novel and improved superstructure for use in a rail-mounted conveyance.

A further object of the invention is to provide a conveyance which can be used as a superior substitute for heretofore known conveyances for travel along rails which define arcuate paths for the conveyance and which also slope up and down while the conveyance travels in a curve.

Another object of the invention is to provide a conveyance which is not only more reliable and more versatile but also simpler, more compact and less expensive than heretofore known conveyances which are used for similar or analogous purposes.

A further object of the invention is to provide a novel and improved method of lowering the center of gravity of the load on a conveyance of the above outlined character.

The invention is embodied in a rail-mounted conveyance, particularly for use in underground excavations, which comprises an undercarriage having wheels arranged to travel along two parallel rails, a superstructure which can include a load-supporting device, and means for articulately connecting the superstructure to the undercarriage with freedom of movement about three axes including a first axis (X-axis) extending in the direction of travel of the conveyance, a second axis (Y-axis) extending transversely of the direction of travel of the conveyance, and a third axis (Z-axis) which is at least substantially normal to the first and second axes. The connecting means comprises a first member which forms part of the undercarriage and has a first surface and a second member which forms part of the superstructure and has a second surface in substantially linear contact with the first surface. The line of contact between the first and second surfaces defines the first axis and at least one of the two surfaces is convex so that the other surface can perform a rolling movement therealong or vice versa with attendant sidewise shifting of the first axis in the direction of the second axis. The conveyance further comprises means for coupling the first and second members to one another so as to confine the first and second surfaces to the aforementioned rolling movement with reference to each other. Still further, the conveyance comprises a second undercarriage which is connected to the superstructure and is spaced apart from the first mentioned undercarriage, as considered in the direction of the first axis. The connection between the second undercarriage and the superstructure can be such that these components of the conveyance are movable relative to each other about an Y-axis and also about an X-axis.

The convex surface is preferably the first surface, i.e., the surface of the first member which forms part of the undercarriage, and the second surface is or can be flat.

The coupling means can comprise a pair of projections which are provided on one of the two members and extend from the respective surface. These projections are spaced apart from each other, as considered in the direction of the second axis, and the surface of the other member is provided with sockets for the projections of the one member. The projections preferably taper in a direction from the surface of the one member toward the other member and the sockets of the other member are preferably at least substantially complementary to the respective projections. The two projections and the two sockets are preferably disposed at the opposite sides of the central portion of the undercarriage (i.e., a locus midway between the two rails), as considered in the direction of the second axis, and are preferably equidistant from the central portion. It is presently preferred to provide the sockets in the convex surface.

Alternatively, or in addition to the projections, the coupling means can comprise at least one flexible element (cord, rope, cable or the like) the first end portion of which is secured to the superstructure and the second end portion of which is secured to the undercarriage. For example, one of the aforementioned surfaces can have a groove extending in the direction of the first axis to receive a median portion of the flexible element.

The undercarriage preferably further comprises two pairs of wheels at the opposite sides of the superstructure, a rocker arm for each pair of wheels, and an axle connecting the rocker arms and defining the second axis. The axle is connected to or made integral with the first member, i.e., with the member which is preferably provided with the convex surface. The second member can constitute a platform having a flat underside which constitutes the second surface. The aforementioned projections are preferably provided at the underside of the platform.

The superstructure can further comprise a turntable which is disposed at a level above the platform, and the connecting means then further comprises pivot means defining the third axis and connecting the turntable to the platform. The pivot means can comprise a vertical shaft extending from the platform upwardly into the turntable, a disc which is recessed into the upper side of the turntable, and screws or other suitable fastener means for securing the disc to the shaft.

The coupling means can further comprise a pair of cheeks provided on one of the two members (e.g., on the second member or on another component part of the superstructure) and flanking the other member. The cheeks are spaced apart from one another, as considered in the direction of the first axis. Such coupling means can further comprise an elongated bar, rod or an analogous coupling element which is parallel to the first axis, whose end portions are connected to the two cheeks, and which extends through that member (preferably the first member) which is flanked by the two cheeks. The member which is flanked by the two cheeks can be formed with an elongated passage receiving the coupling element with at least some freedom of sidewise movement which is needed to allow the two surfaces to roll along each other. Alternatively, the cheeks can be formed with holes which receive with requisite play the respective end portions of the coupling element.

The novel features which are considered as characteristic of the invention are set forth in particular in the appended claims. The improved conveyance itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
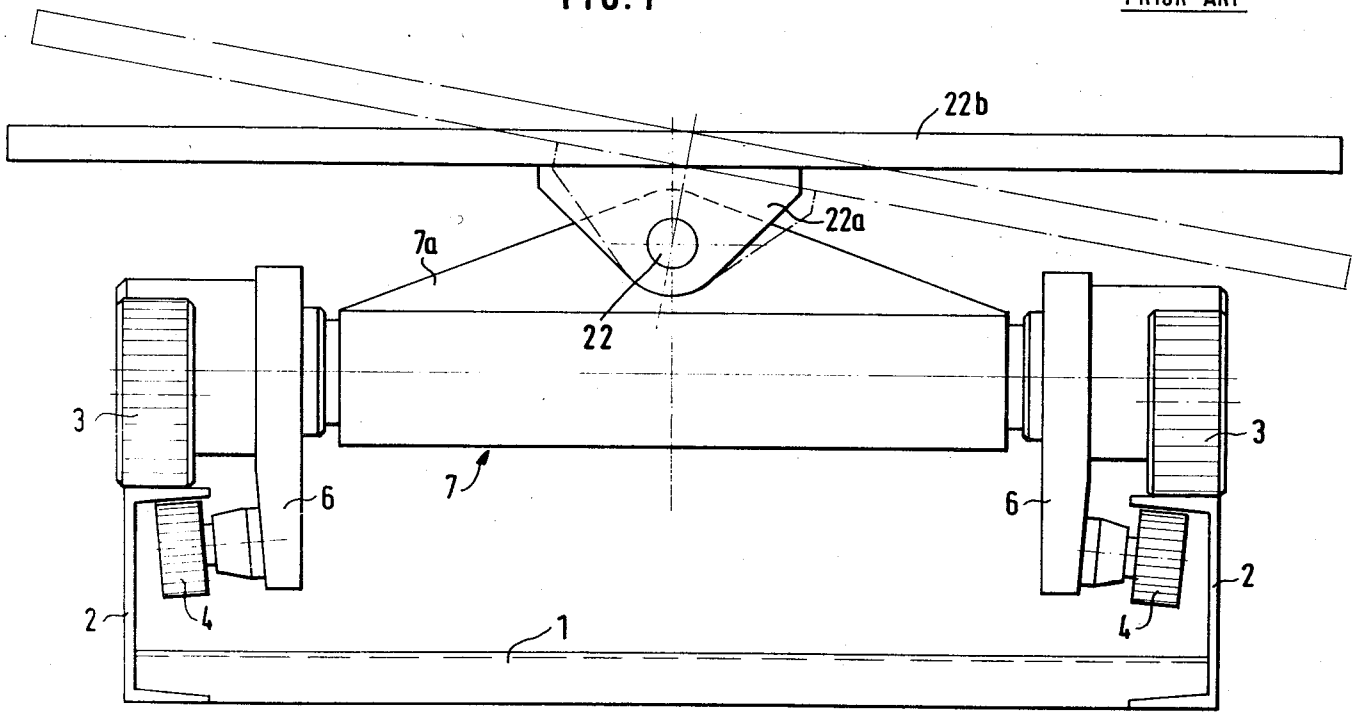
FIG. 1 is an end elevational view of a conventional conveyance.

FIG. 1 shows a conventional conveyance wherein an undercarriage or truck includes a transversely extending horizontal axle 7 whose end portions are connected with rocker arms 6 for pairs of wheels 3 travelling along the upper flanges of the respective rails 2 in a mine or the like. The rocker arms 6 further carry pairs of safety rolls 4 which engage the undersides of the upper flanges of the respective rails 2 to thus ensure that the respective wheels 3 remain in contact with such flanges. The rails 2 are mounted on ties 1 in any suitable way. The axle 7 carries an upwardly extending bracket **7*a* the central portion of which supports a horizontal pivot member 22 at a level above the rocker arms 6. The pivot member 22 is further connected with a bearing member 22*a* at the underside of a tiltable load supporting platform 22*b* which is movable between the solid-line position, between the phantom-line position and a third position which is a mirror image of the phantom-line position. The axis of the pivot member 22 is parallel to the rails 2. The pivot member 22 must be mounted at a level well above the axle 7 in order to ensure that the lateral portions of the platform 22 will not strike against the respective rocker arms 6 when the platform is tilted to the one or the other end position under the circumstances which were outlined above, e.g., when the conveyance including the structure of FIG. 1** travels along an arcuate path which slopes upwardly or downwardly.

Figure 2:
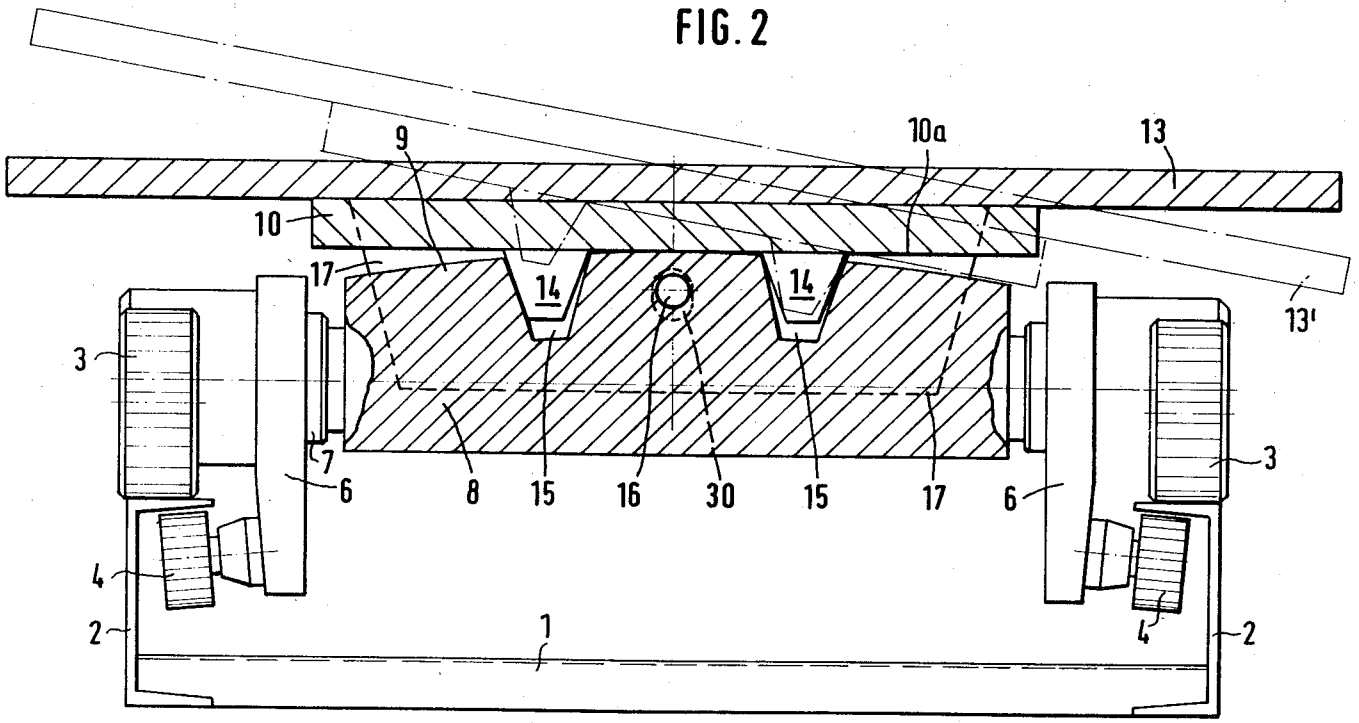
FIG. 2 is a transverse vertical sectional view of the superstructure and one undercarriage of a conveyance which is constructed and assembled in accordance with the present invention.
Figure 3:
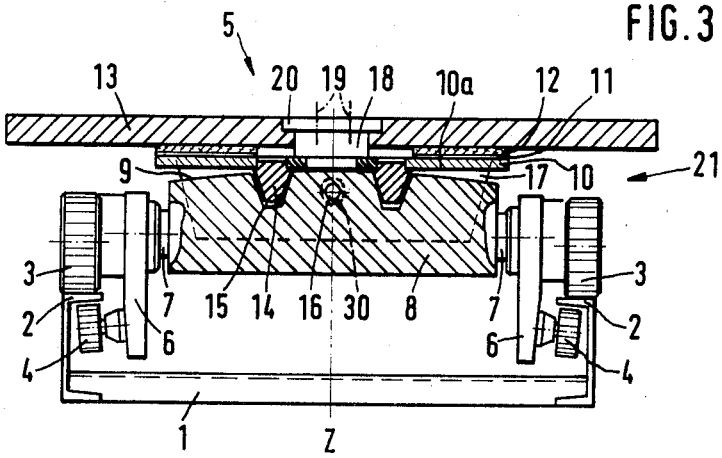
FIG. 3 is a smaller-scale sectional view similar to that of FIG. 2 but showing further details of the superstructure.
Figure 4:
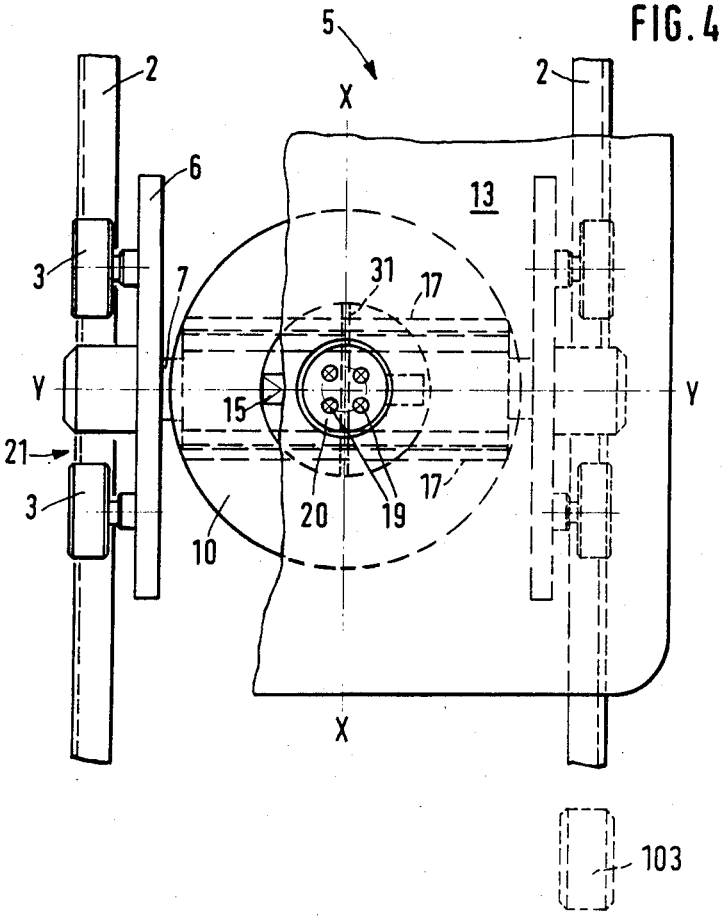
FIG. 4 is a fragmentary plan view of the structure of FIG. 3, with a portion of the turntable of the superstructure broken away.

FIGS. 2 to 4 illustrate a conveyance 5 which is constructed and assembled in accordance with the invention. The two rails 2 are mounted on ties 1 (shown only in FIGS. 2 and 3) and their top flanges are engaged by the respective pairs of wheels 3 forming part of an undercarriage 21 which is connected to a superstructure including a turntable 13 in such a way that the turntable can pivot back and forth between two end positions one of which is shown at 13′ and the other of which is a mirror image of the position 13′ with reference to a plane which is normal to the plane of FIG. 2 or 3, namely, with reference to a plane including the (first) axis X shown in FIG. 4. The pairs of wheels 3 are mounted on rocker arms 6 which further carry pairs of safety rolls 4, the same as in the conventional conveyance of FIG. 1. The illustrated undercarriage 21 of the conveyance 5 further comprises a block-shaped member 8 which is integral with and can be said to form part of the axle 7 for the rocker arms 6 (or vice versa) and which has a convex top surface 9 sloping gradually from the center of the undercarriage toward the two rails 2. The top surface 9 slopes only in directions from the center toward the two rails 2 but is straight or flat as considered in the direction of travel of the conveyance 5, i.e., in the longitudinal direction of the rails 2.

The superstructure of the conveyance 5 includes the aforementioned turntable 13 which carries the load as well as a circular disc-shaped member or platform 10 having a flat bottom surface or underside 10*a* which is in linear contact with the convex surface 9 of the member 8. The line of contact between the surfaces 9 and 10*a* constitutes the first or X-axis about which the undercarriage 21 can move with reference to the superstructure and/or vice versa. As can be seen in FIG. 2, the line of contact between the surfaces 9 and 10*a* moves sideways in response to tilting of the turntable 13 and platform 10 with reference to the undercarriage 21 or the other way around. However, such line of contact remains parallel to the rails 2, i.e., to the direction of travel of the conveyance 5 along the rails. The superstructure further includes a disc-shaped washer 11 which can be made of brass or bronze and is disposed between the platform 10 and a rubber disc 12 which latter is adjacent to the underside of the turntable 13. The disc 2 can be bonded to the washer 11.

The means for coupling the members 8 and 10 to one another so that the surface 10*a* of the member 10 remains in linear contact with the surface 9, while the member 10 (and hence also the turntable 13) swivels or pivots about the line of contact between the two surfaces, includes two projections 14 which extend downwardly from the surface 10*a* of the platform 10 and into at least substantially complementary sockets 15 which are machined into or otherwise formed in the surface 9 of the member 8. Each of the projections 14 can resemble or constitute a pyramidal frustum which tapers in a direction toward the horizontal (second) axis Y defined by the axle 7 and extending transversely of the rails 2. The projections 14 are disposed at the opposite sides of the center of the undercarriage 21 (i.e., of a location midway between the rails 2) and are spaced apart from one another, as considered in the direction of the Y-axis. The coupling means further comprises two cheeks 17 which extend downwardly from the platform 10 or from another component of the superstructure and flank the member 8. These cheeks are spaced apart from one another, as considered in the direction of the X-axis, and the coupling means further comprises an elongated rod-shaped coupling element 16 which is parallel to the X-axis, whose end portions are connected with the cheeks 17, and which can extend with a certain amount of play through an elongated passage of the member 8. Such passage has or can have an oval cross-sectional outline and receives the coupling element 16 with sufficient play to ensure that the turntable 13 can move to the end position 13′ which is shown in FIG. 2 by phantom lines as well as to the other end position. Alternatively, and as actually shown in FIG. 3, the central portion of the coupling element 16 can be fixedly mounted in the member 8 and its end portions are then received with play in oval holes or passages 30 of the cheeks 17.

The turntable 13 can turn with reference to the platform 10 about a vertical third axis Z. To this end, the platform 10 is connected with a short pivot member or shaft 18 which extends upwardly through the parts 11, 12 and into a registering hole of the turntable 13. The upper side of the turntable 13 has a shallow recess for a disc 20 which is separably but fixedly secured to the shaft 18 by four screws 19 or analogous fasteners. The shaft can be welded or otherwise fixedly connected to or made an integral part of the platform 10.

It will be noted that the undercarriage 21 and the superstructure including the parts 10 to 13 are articulately connected to each other for movement about three mutually inclined axes X, Y and Z. The X-axis is defined by the members 8 and 10 which respectively constitute component parts of the undercarriage and of the superstructure. The Y-axis is defined by the axle 7, and the Z-axis is defined by the shaft 18. The position of the X-axis shifts back and forth between the rails 2 in dependency on the mutual inclination of the Y-axis and the plane of the turntable 13. FIG. 3 shows the X-axis in the middle between the two rails 2 because the plane of the platform 10 (and hence the plane of the turntable 13) is parallel to the Y-axis. The X-axis moves nearest to the right-hand rail 2 of FIG. 2 when the turntable 13 assumes the phantom-line position 13′, and such axis moves nearest to the left-hand rail when the turntable 13 assumes the other end position which is a mirror image of the phantom-line position 13′ shown in FIG. 2. The depth of the sockets 15 and the length of the complementary projections 14 can be selected in such a way that only one of the sockets 15 receives the corresponding projection 14 when the turntable 13 assumes one of its end positions. This can be seen in FIG. 2 wherein the left-hand projection 14 is lifted above or practically above the arcuate surface 9 when the platform 13 is tilted to its phantom-line position 13′ (the corresponding position of the left-hand projection 14 is indicated by phantom lines). However, this suffices to ensure that the surfaces 9 and 10*a* are held in linear contact with one another in all positions of inclination of the turntable 13 relative to the undercarriage 21 and/or vice versa. The parts 16 and 17 of the coupling means prevent excessive lifting of the superstructure above the undercarriage 21 because the coupling element 16 is held against sidewise movement relative to the member 8 and its end portions are connected to the respective cheeks 17 of the superstructure. The provision of cheeks 17 and coupling element 16 is desirable and advantageous because such parts of the coupling means prevent complete separation of the undercarriage 21 from the superstructure under certain extremely adverse circumstances, e.g., in response to such shaking of the conveyance that, in the absence of parts 16 and 17, both projections 14 would be likely to simultaneously move out of the corresponding sockets 15.

A comparison of FIGS. 1 and 2 will show that the platform 22*b* of the conventional conveyance is located at a level well above that of the turntable 13 in the conveyance 5 of the present invention. For convenience of comparison, the dimensions of the parts of the conventional conveyance shown in FIG. 1 are identical with the dimensions of the corresponding parts of the improved conveyance 5 shown in FIG. 2. The maximum extent of inclination of the platform 22*b* of FIG. 1 is the same as that of the turntable 13 in the improved conveyance. All this is achieved by the expedient of providing an X-axis which can move sideways between the two rails 2, i.e., which need not remain fixed between the two rails in a manner as shown in the conventional conveyance of FIG. 1. In fact, when the turntable 13 assumes the one or the other end position, the distance between the X-axis and the respective (nearer) rail 2 is reduced to a small fraction of half the distance between the two rails, i.e., to a small fraction of the distance between the axis of the pivot member 22 of FIG. 1 and the two rails 2. Such sidewise wandering of the X-axis in the improved conveyance 5 renders it possible to mount the turntable 13 at a level well below the level of the platform in a conventional conveyance without reducing the extent of pivotability of the turntable 13 about the X-axis.

It is clear that the improved conveyance is susceptible of many additional modifications. For example, the underside of the member 10 can constitute a convex surface and the member 8 can be formed with a flat top surface. Alternatively, each of the surfaces 9 and 10*a* can be a convex surface.

Furthermore, the projections 14 can be provided on the member 8 to then extend into complementary sockets in the surface 10*a* of the member 10. The construction which is shown in the drawing is preferred at this time because the member 8 must have a certain thickness in order to be capable of supporting the load so that the provision of sockets 14 in the surface 9 contributes to a reduction of the combined height of the undercarriage 21 and the superstructure.

The coupling means can comprise (in addition to or in lieu of the projections 14, socket 15, cheeks 17 and coupling element 16) an elongated flexible element in the form of a band, strip, cord, cable, rope or the like which is received in a groove machined into the surface 9 and/or 10*a* and extending in parallelism with the X-axis. One end portion of such flexible element is secured to the undercarriage 21 and its other end portion is secured to the superstructure. FIG. 4 shows schematically a median portion of a cable 31 which is received in a centrally located groove of the convex surface 9. The front end of such cable is or can be secured to the platform 10 and the rear end of the cable is then secured to the member 8 or to another part of the undercarriage 21.

The illustrated releasable connection between the shaft 18 and the turntable 13 is preferred at this time in view of its simplicity; however, it can be replaced with a permanent connection or with another separable connection of any known design. Also, the turntable 13 constitutes but one of a wide variety of load supporting devices which can be used in the superstructure of the improved conveyance 5.

The second undercarriage of the improved conveyance need not be connected with the superstructure for articulation about three mutually inclined axes. It suffices if the second undercarriage defines an Y-axis and a Z-axis. One wheel of the second undercarriage is indicated in FIG. 4 by broken lines, as at 103.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A rail-mounted conveyance, particularly for use in underground excavations, comprising an undercarriage; a superstructure; and means for articulately connecting said superstructure to said undercarriage with freedom of movement about three axes including a first axis extending in the direction of travel of the conveyance, a second axis extending transversely of the direction of travel of the conveyance, and a third axis at least substantially normal to said first and second axes, said connecting means comprising a first member forming part of said undercarriage and having a first surface and a second member forming part of said superstructure and having a second surface in substantially linear contact with said first surface, the line of contact between said surfaces defining said first axis and one of said surfaces being convex so that the other of said surfaces can perform a rolling movement therealong or vice versa with attendant sidewise shifting of said first axis in the direction of said second axis.

2. The conveyance of claim 1, further comprising means for coupling said members to one another to thereby confine said surfaces to said rolling movement with reference to each other.

3. The conveyance of claim 2, further comprising a second undercarriage connected to said superstructure and spaced apart from said first mentioned undercarriage, as considered in the direction of travel of the conveyance.

4. The conveyance of claim 2, wherein said convex surface is said first surface.

5. The conveyance of claim 2, wherein said coupling means comprises a pair of projections provided on one of said members and extending from the respective surface, said projections being spaced apart from one another, as considered in the direction of said second axis, and the surface of the other of said members having sockets for said projections.

6. The conveyance of claim 5, wherein said projections taper in a direction from the surface of said one member toward the other member and the sockets of said other member are at least substantially complementary to the respective projections.

7. The conveyance of claim 6, wherein said undercarriage has a central portion and said projections are disposed at the opposite sides of such central portion, as considered in the direction of said second axis.

8. The conveyance of claim 6, wherein said sockets are provided in said convex surface.

9. The conveyance of claim 2, wherein said coupling means comprises at least one flexible element having a first end portion secured to said superstructure and a second end portion secured to said undercarriage.

10. The conveyance of claim 9, wherein one of said surfaces has a groove extending in the direction of said first axis and said flexible element includes a median portion disposed in said groove.

11. The conveyance of claim 2, wherein said undercarriage further comprises two pairs of wheels at the opposite sides of said superstructure, a rocker arm for each pair of wheels, and an axle connecting said rocker arms and defining said second axis, said axle being connected with said first member.

12. The ccnveyance of claim 11, wherein said second member constitutes a platform.

13. The conveyance of claim 11, wherein said axle is integral with said first member and said convex surface is said first surface.

14. The conveyance of claim 11, wherein said second member constitutes a platform having an underside which constitutes said second surface.

15. The conveyance of claim 14, wherein said coupling means comprises a pair of projections provided at the underside of said platform, the surface of said first member having complementary sockets for such projections.

16. The conveyance of claim 14, wherein said superstructure further includes a turntable and said connecting means further includes pivot means defining said third axis and connecting said turntable to said platform.

17. The conveyance of claim 16, wherein said turntable is disposed at a level above said platform.

18. The conveyance of claim 17, wherein said pivot means includes a shaft extending from said platform upwardly into said turntable, a disc recessed into the upper side of said turntable, and fastener means securing said disc to said shaft.

19. The conveyance of claim 2, wherein said coupling means comprises a pair of cheeks provided on one of said members and flanking the other of said members, said cheeks being spaced apart from one another, as considered in the direction of said first axis.

20. The conveyance of claim 19, wherein said coupling means further comprising an elongated coupling element parallel to said first axis, having end portions connected to said cheeks and extending through that member which is flanked by said cheeks, said cheeks having holes receiving said coupling element with at least some freedom of sidewise movement therein.

* * * * *